US011685070B2

(12) United States Patent
Brette et al.

(10) Patent No.: US 11,685,070 B2
(45) Date of Patent: Jun. 27, 2023

(54) BLADE ASSEMBLIES WITH LUBRICATING ELEMENTS

(71) Applicant: SOCIETE BIC, Clichy (FR)

(72) Inventors: Thomas Brette, Saint Germain en Laye (FR); Giorgos Georgakis, Athens (GR)

(73) Assignee: SOCIÉTÉ BIC, Clichy (FR)

( * ) Notice: Subject to any disclaimer, the term of this patent is extended or adjusted under 35 U.S.C. 154(b) by 102 days.

(21) Appl. No.: 17/251,105

(22) PCT Filed: Jul. 18, 2019

(86) PCT No.: PCT/EP2019/069354
§ 371 (c)(1),
(2) Date: Dec. 10, 2020

(87) PCT Pub. No.: WO2020/016354
PCT Pub. Date: Jan. 23, 2020

(65) Prior Publication Data

US 2021/0252726 A1 Aug. 19, 2021

(30) Foreign Application Priority Data

Jul. 18, 2018 (EP) ..... 18184258

(51) Int. Cl.
*B26B 21/44* (2006.01)
*B26B 21/40* (2006.01)
(Continued)

(52) U.S. Cl.
CPC ..... *B26B 21/443* (2013.01); *B26B 21/4012* (2013.01); *B26B 21/06* (2013.01); *B26B 21/222* (2013.01)

(58) Field of Classification Search
CPC ..... B26B 21/14; B26B 21/16; B26B 21/22; B26B 21/225; B26B 21/40;
(Continued)

(56) References Cited

U.S. PATENT DOCUMENTS 1,741,891 A * 12/1929 Vallon ..... B26B 21/44 30/41
2,677,883 A * 5/1954 Schallgruber ..... B26B 21/44 30/41
(Continued)

FOREIGN PATENT DOCUMENTS

CN 105219007 A 1/2016
EP 0446430 A1 9/1991
(Continued)

OTHER PUBLICATIONS

International Search Report and Written Opinion in International Application No. PCT/EP2019/069354, dated Oct. 7, 2019 (12 pages).

*Primary Examiner* — Jason Daniel Prone
(74) *Attorney, Agent, or Firm* — Bookoff McAndrews, PLLC

(57) ABSTRACT

A blade assembly includes a housing having a recess defining a first wall on a first side of the housing and a second wall on a second side of the housing, an elongated body that is attached to the first and second walls and is rotatable about a longitudinal axis (S-S), the elongated body having two or more facets, at least one of the facets has a lubricating element disposed thereon, and a locking mechanism for releasably locking the body in a use position.

20 Claims, 6 Drawing Sheets

(51) Int. Cl.
*B26B 21/06* (2006.01)
*B26B 21/22* (2006.01)

(58) Field of Classification Search
CPC ..... B26B 21/4012; B26B 21/4025; B26B 21/4037; B26B 21/44; B26B 21/443
USPC ..... 30/34.1, 47–51, 58, 84
See application file for complete search history.

(56) References Cited

U.S. PATENT DOCUMENTS 2,837,820 A * 6/1958 Ostrowski ..... B26B 21/16 30/51
2,861,338 A * 11/1958 Boland ..... B26B 21/44 30/41
3,895,437 A 7/1975 DiBuono
3,969,817 A * 7/1976 DiBuono ..... B26B 21/44 30/41
4,378,633 A * 4/1983 Jacobson ..... B26B 21/227 30/47
4,562,644 A 1/1986 Hitchens
4,697,342 A 10/1987 Ferraro
4,944,090 A 7/1990 Sumnall
5,036,587 A * 8/1991 Trotta ..... B26B 21/44 30/41
5,107,590 A * 4/1992 Burout, III ..... B26B 21/528 30/47
5,199,173 A * 4/1993 Hegemann ..... B26B 21/225 30/49
5,493,778 A 2/1996 Ichiyanagi
5,669,139 A * 9/1997 Oldroyd ..... B26B 21/222 30/47
5,678,311 A * 10/1997 Avidor ..... B26B 21/34 30/50
5,713,131 A 2/1998 Rogers et al.
6,532,667 B1 * 3/2003 Leaseburge ..... B26B 21/443 30/41
7,103,976 B2 * 9/2006 Pennella ..... B26B 21/44 30/50
7,367,125 B2 * 5/2008 Aviza ..... B26B 21/44 30/50
7,540,088 B2 * 6/2009 Takeshita ..... B26B 21/44 30/77
7,703,361 B2 * 4/2010 Johnson ..... B26B 21/44 30/50
8,236,214 B2 8/2012 Kwiecien
8,307,552 B1 * 11/2012 Drouillard ..... B26B 21/40 30/32
10,093,031 B2 * 10/2018 Ren ..... B26B 21/4025
2002/0157255 A1 10/2002 Coffin
2004/0123467 A1 * 7/2004 Policappelli ..... B26B 21/24 30/50
2004/0139611 A1 7/2004 Vreeland
2005/0126007 A1 6/2005 Aviza
2005/0198826 A1 9/2005 Segrea
2007/0214647 A1 * 9/2007 Psimadas ..... B26B 21/40 30/50
2009/0013534 A1 * 1/2009 Mallaridas ..... B26B 21/40 30/50
2009/0211099 A1 * 8/2009 Louis ..... B26B 21/44 30/41
2009/0223057 A1 9/2009 Coope-Epstein et al.
2011/0219625 A1 * 9/2011 Bryan ..... B26B 21/24 30/50
2013/0042482 A1 2/2013 Bradford et al.
2015/0107114 A1 * 4/2015 Minsk ..... B26B 21/44 30/41
2016/0096280 A1 * 4/2016 Robertson ..... B26B 21/225 30/51
2016/0338928 A1 11/2016 Haught et al.
2017/0173805 A1 6/2017 Ren
2020/0023530 A1 * 1/2020 Burkhart ..... B26B 21/4012
2021/0245380 A1 * 8/2021 Petratou ..... B26B 21/44
2021/0308888 A1 * 10/2021 Gratsias ..... B26B 21/443
2022/0097244 A1 * 3/2022 Kopelas ..... B26B 21/4012

FOREIGN PATENT DOCUMENTS

EP 0551407 B1 6/1996
EP 1257392 B1 11/2003
EP 2365898 B1 3/2013
EP 2365896 B1 8/2016
EP 2365897 B1 12/2016
EP 2323817 B1 11/2017
GB 2342884 A 4/2000

* cited by examiner

BLADE ASSEMBLIES WITH LUBRICATING ELEMENTS

CROSS REFERENCE TO RELATED APPLICATION(S)

This application is a National Stage Application of International Application No. PCT/EP2019/069354, filed on Jul. 18, 2019, now published as WO2020016354 and which claims priority from European Application No. EP18184258.4, filed on Jul. 18, 2018.

TECHNICAL FIELD

The disclosure concerns shaving blade assemblies, and more specifically blade assemblies comprising a rotatable body that may have a lubricating element thereon.

PRIOR ART

It is common practice to include a lubricating strip or shaving aid on a razor head to improve the shaving experience of a shaving blade user, for example, a lubricating strip may be adapted to facilitate gliding of a razor blade on the surface of the skin, or provide other skin benefits.

Most often, only one surface of the lubricating strip contacts the surface of the skin during shaving, regardless of its shape. For example, only one surface of the lubricating strip may contact the skin when the configuration of the lubricating strip is a: mushroom shape, round shape, semi-round shape, triangular shape, rectangular shape, square shape, sloped shape (e.g. EP2323817) or 'T'-shape (e.g. US20170173805) or cylindrical shape (e.g. U.S. Pat. No. 5,493,778) or rectangular shape (e.g. U.S. Pat. No. 4,697,342) or wedge shape (e.g. EP446430). Therefore, for all intents and purposes, the upper surface of a lubricating strip is the primary surface that is used during shaving. Consequently, any other surface of the lubricating strip, regardless of the shape of the lubricating strip, may not be accessible to the user and, thus, may not contain any lubricious composition.

Due to the aforementioned limitations, a razor blade may comprise a lubricating strip which has a shorter lifecycle than the razor blades. In particular, the lubricating strip or shaving aid may wear off before the razor blades are damaged or dull.

Several documents provide an attempt to overcome this drawback by detailing that the lubricating body can be constructed as multiple layers and that each layer may contribute to a different effect to the user (e.g., EP2365896, EP1257392, EP2365897, EP2365898, and US20040139611).

Moreover, the concept of a lubricating strip that is configured to be replaceable has been detailed in, for example, US2002157255, GB2342884, US20050198826, which relate to shaving aid in rollers. To this direction, US2005/126007 and U.S. Pat. No. 4,562,644 also relate to shaving aid deposited on rolling elements.

SUMMARY

According to some aspects, a blade assembly is provided. The blade assembly comprises a housing having a recess. The recess is defined by a first wall on a first side of the housing and a second wall on a second side of the housing. The blade assembly further comprises an elongated body that may be attached to the first and second walls and may be rotatable about a longitudinal axis. The elongated body may have two or more facets, wherein at least one of the facets may have a lubricating element disposed thereon. The blade assembly further comprises a locking mechanism that may be configured to releasably lock the body in a use position.

In these aspects, the blade assembly may have more than one lubricating element thereby resulting in an improved shaving effect and extended service life. Furthermore, the blade assemblies as herein disclosed provide for adaptable lubrication of skin as per user's needs, e.g., the user decides to change the lubricating surface when they perceive it as being insufficiently lubricative or to change it for benefiting from another surface with different lubricious composition. In other words, the provision of a blade assembly comprising a rotatable body having two or more facets with a lubricating element disposed thereon offers to the user the flexibility to have access to different lubricating elements (having the same or different compositions) or change the lubricating surface when the user perceives it as insufficiently lubricative.

The body may further include a first support element comprising either a first shaft or a first recess and a second support element comprising either a second shaft or a second recess, each of the first and second support elements being formed along the longitudinal axis of the body and on opposing ends of the facets.

Forming the support elements on either ends of the body permits the body to rotatably connect to the housing. This functionality for rotation combined with the prismatic configuration of the body results in a multi-faceted structure that facilitates selection of multiple lubricating elements.

The body may be configured to rotate about a longitudinal axis that is parallel to a longitudinal axis of the housing.

This orientation allows for the body to have a compact and integrated position within the housing.

The end of the second support element may define an engagement surface.

The engagement surface allows the locking member to restrict the rotational movement of the body.

The end of the second support element comprises one or more protuberances that may be formed offset from the longitudinal axis of the body.

The protuberances allow for restricting the rotational movement of the body.

The engagement surface formed at the end of the second support element may define one or more indentations that are formed offset from the longitudinal axis of the body.

The indentations allow for restricting the rotational movement of the body.

The blade assembly may further include a spring configured to urge the locking mechanism into a locking position.

The spring effectively locks the locking mechanism in place and helps to prevent unwanted movement of the body during a shaving operation.

The locking mechanism may be adapted to restrict the rotation of the body by the spring urging the locking mechanism to engage the engagement surface formed at the end of the second support element.

This configuration effectively locks the locking mechanism in place and helps to prevent unwanted movement of the body during a shaving operation.

The spring may be fixed to and disposed around an outer surface of the locking mechanism.

This configuration permits the locking mechanism and spring to operate in concert.

The spring may be configured to adopt two states, an extended state in which rotation of the body (60) is restricted and a compressed state in which rotation of the body (60) is permitted.

When the spring is in an extended state, the spring urges the locking mechanism against the body such that unwanted rotation of the body can be avoided while a user is performing a shaving operation.

When the spring is in a compressed state the rotation of the body may be permitted, allowing the user to select a lubricating element from a plurality of available lubricating elements, but also have a device where unwanted rotation of the body can be avoided while a user is performing a shaving operation. The second side of the housing may include a retaining portion formed on the interior surface of the second wall, wherein the locking mechanism may be disposed within the retaining portion.

Positioning the locking mechanism inside of the housing prevents unwanted dislodgement from the locking position as well as provides a compact configuration. The locking mechanism may be configured to slide relative to the retaining portion of the housing.

This configuration facilitates transitioning between facets on the body.

The locking mechanism may be configured to move in a direction parallel to the longitudinal axis of the body.

Positioning the locking mechanism to move parallel to the longitudinal axis of the body provides a compact and simplified configuration.

The locking mechanism may be offset from the longitudinal axis of the body and may be configured to contact the engagement surface formed at the end of the second support element.

The locking mechanism being offset from the longitudinal axis of the body allows the locking mechanism to be positioned between adjacent protuberances on the engagement surface of the second support element when the spring is in an extended state.

Two or more facets of the body may have a lubricating element disposed thereon.

With this configuration, the user can have several lubricating elements to choose from. Each of the aids and skin benefits from each of the lubricating elements may be the same, may be different, and any combination thereof.

In examples, the first support element is the first shaft which extends through the first side of the housing.

This configuration allows for an alternative means for selectively rotating the body.

In examples, the body may further include a toggle fixed to an end of the first shaft.

In some of these examples, the toggle may provide a more secure means for rotating the body in that the toggle is positioned away from the blades.

In examples, the toggle may be adapted to drive rotation of the body.

This configuration facilitates safe selective rotation of the body.

In aspects, a razor may be provided; the razor may comprise the disclosed blade assembly and a handle connected to the blade assembly.

In this configuration, the blade assembly may be used with a handle to aid a user during the shaving process. In examples, the handle may be releasably connected to the blade assembly. In this configuration, a user may keep the handle of the razor and the blade assembly may be interchangeable which reduces cost to the user. The above summary is not intended to describe each and every implementation of the concept. In particular, selected features of any illustrative embodiment within this disclosure may be incorporated into additional embodiments unless clearly stated to the contrary or otherwise incompatible.

BRIEF DESCRIPTION OF THE DRAWINGS

The disclosure may be more completely understood in consideration of the following detailed description of non-limiting aspects of the disclosure in connection with the accompanying drawings, in which.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the present disclosure. The illustrative aspects depicted are intended only as exemplary.

Figure 1:
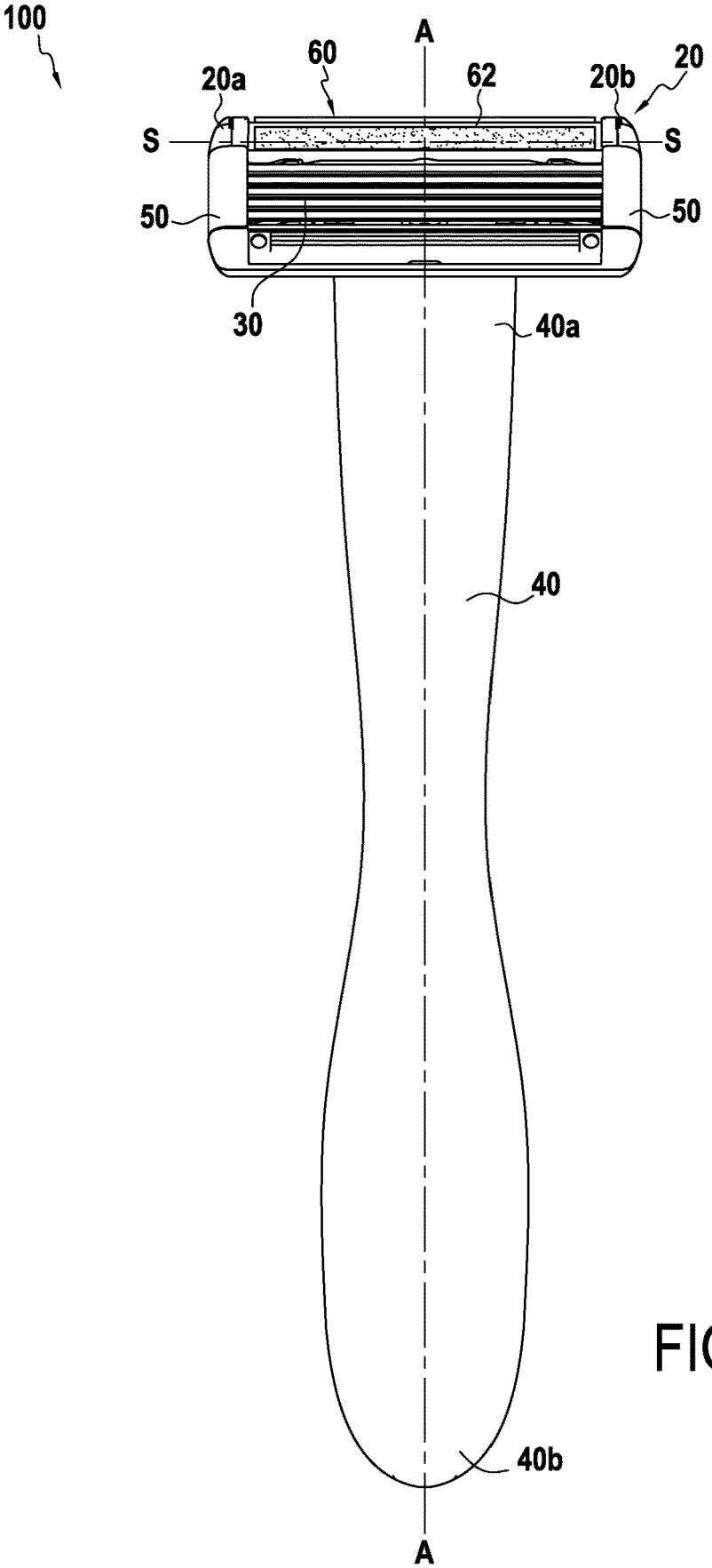
FIG. 1 details a front view of a razor having a multi-faceted body with lubricating element disposed thereon.

An aspect of the disclosure is shown in FIG. 1, which is a front view of a razor 100 having a blade assembly and handle 40 connected to the blade assembly. The blade assembly may have a housing 20 that may be hollow and generally form a rectangular parallelepiped; however, the housing 20 may be any other suitable shape. The handle 40 may extend along a vertical central axis A-A. The handle may have a top portion 40*a* and a bottom portion 40*b*. The handle 40 may be shaped to better adapt to the natural contours of a hand. The top portion 40*a* of the handle 40 may have a connecting member (not shown) that is adapted to connect to the housing 20 of the blade assembly. The blade assembly may be monolithically formed with the handle 40, it may be fixed to the handle 40, or it may be releasably connected to the handle 40 and thus it may further be interchangeable with the handle 40.

Figure 2A:
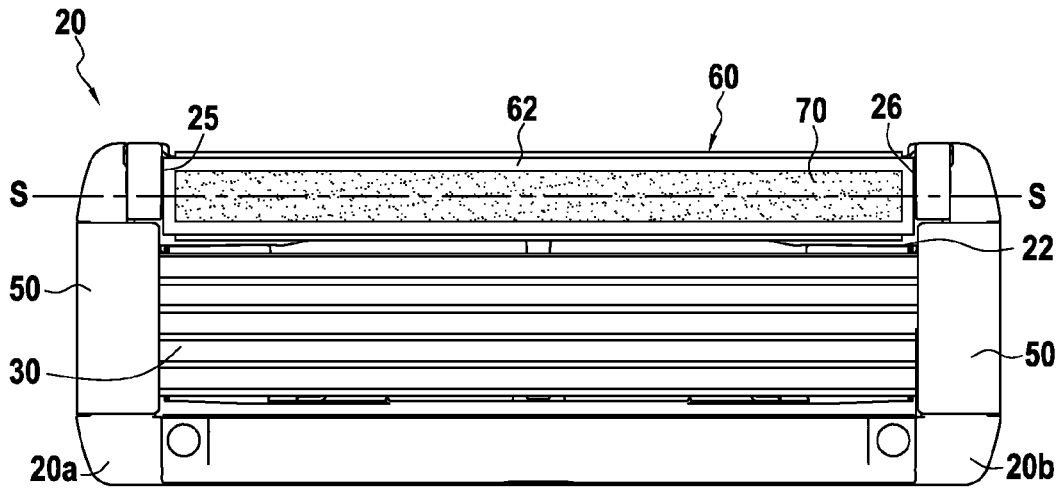
FIG. 2A details a front view of the blade assembly of the razor of FIG. 1.

As can be seen in FIGS. 1 and 2A, at least one blade 30 is secured within the housing 20. In this embodiment, a plurality of blades 30 are shown, however, it is contemplated that the blade assembly may have any number of blades 30.

Additionally, the blades 30 that are shown are elongate in shape; however, it is contemplated that the blades 30 may be formed into any other suitable shape. Additionally, each blade may be one piece, bent to form an angle, or may comprise a blade support where the cutting portion of the blade is attached on the blade support.

The housing 20 may also include a guard bar, a cap, and a pair of substantially c-shaped retainers 50 each having a top portion, a bottom portion, a substantially convex portion connecting the top and bottom portions, where the retainers 50 are adapted to retain the position of the blades 30 within the housing 20. The retainers 50 may extend along a pair of side edges 20*a*, 20*b* of the housing 20 and are spaced apart and positioned opposite from each other on a first side 20*a* of the housing 20 and a second side 20*b* of the housing 20. The retainers 50 may be either integral with the housing 20 or a separate component assembled with the housing 20. It is envisioned that retainers 50 may be any other suitably configured retaining means, for example clips, and should not be limited to the aforementioned c-shaped design.

Figure 2B:
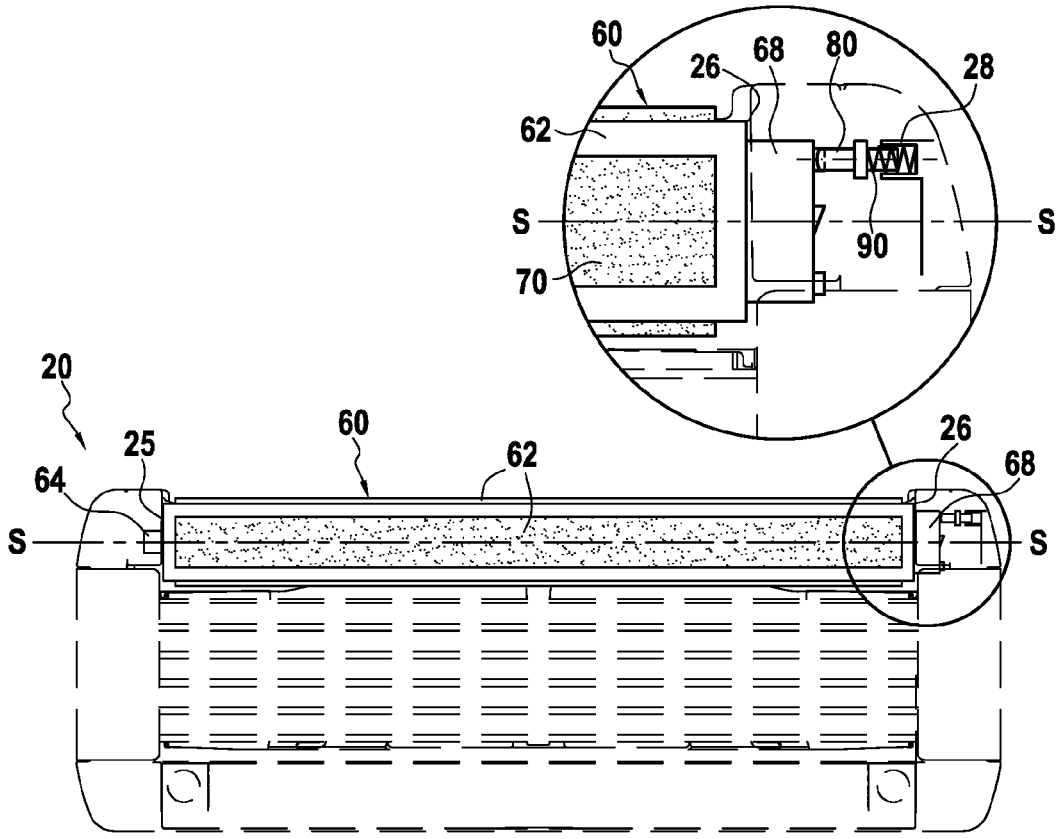
FIG. 2B details a cross-sectional view of the blade assembly of FIG. 2A.
Figure 3A:
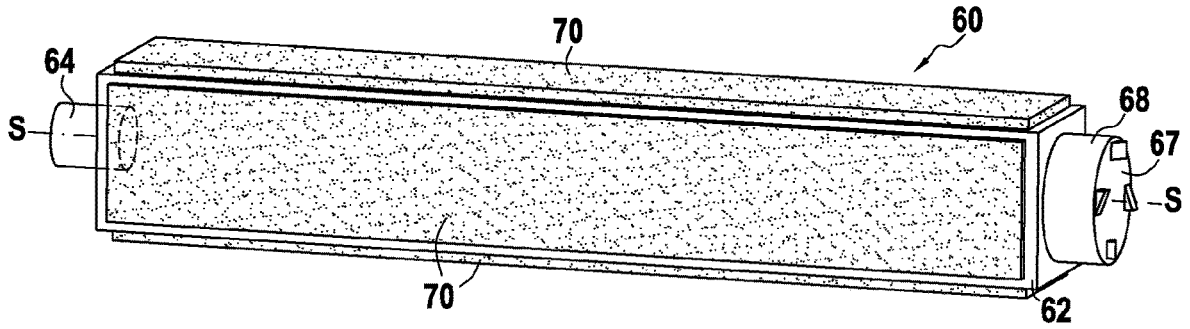
FIG. 3A details a perspective view of the multi-faceted body.
Figure 3B:
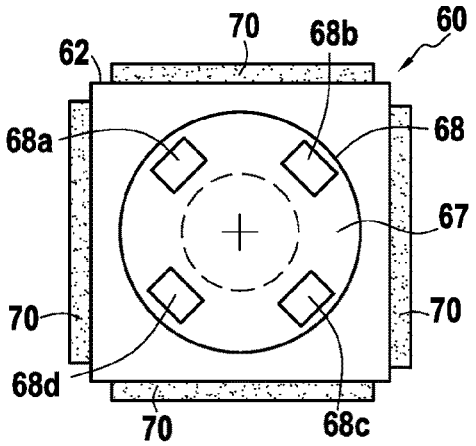
FIG. 3B details a side view of the multi-faceted body of FIG. 3A.

As shown in FIGS. 2A and 2B, the housing 20 may define a recess 22 located on its trailing end. The recess 22 may define a first wall 25 and a second wall 26. Each of the first and second walls 25, 26 may have an aperture therein. At least one of the apertures may be configured to communicate with the interior of the housing 20. However, it is also envisioned that the first and second walls 25, 26 may have respective shaft portions extending therefrom. It is also envisioned that either one of the first or second walls 25, 26 may have an aperture, while the other wall has a shaft portion. The aforementioned configuration of the housing 20 to include a recess 22 is not limited only on the trailing end of the housing 20. According to further aspects, the housing 20 may define a recess 22 (for the positioning of the body 60) located either on the leading end of the housing 20, i.e. in the guard bar area (not shown) or on both the trailing and leading ends of the housing 20 (not shown). As can be seen in FIGS. 2A-3B, the blade assembly may further include a body 60 that may be elongate in shape and extend along a longitudinal axis S-S. The body 60 may define two or more facets 62. It is envisioned that the body 60 may have any number of facets 62. The body 60 may be of any suitable prismatic configuration, for example a polyhedron comprising a rectangular base, or a square base, or a polygonal base. The body 60 may have first and second support elements formed on opposing ends thereof. For example, the support elements may be a first shaft 64 and a second shaft 68 formed on opposing ends and extend outwardly therefrom along the longitudinal axis S-S. However, it is also envisioned that the first and second support elements may include recesses on opposing ends and extend inwardly along the longitudinal axis S-S. It is also envisioned that the first and second support elements may include a recess on an end and a shaft on an opposing end, each extending along the longitudinal axis S-S. In whichever form the first and second support elements take, the support elements of the body 60 may correspond with the first and second walls 25, 26 of the housing such that the body 60 may be rotatably attached to said housing 20. The body 60 may be configured to rotate about the longitudinal axis S-S. Particularly, the body 60 may be configured to rotate about the longitudinal axis S-S that is parallel to a longitudinal axis of the housing 20. Also, the end of the second support element, e.g. the second shaft 68, may define an engagement surface 67 In some examples, the engagement surface 67 may comprise one or more protuberances 68*a*-68*d* that may be formed offset from the longitudinal axis S-S of the body 60, restricting the rotational movement of the body 60. The rotational movement of the body 60 may be restricted (e.g. by affecting one direction), even via a single protuberance, whereas two or more protuberances 68*a*-68*d* may further restrict the rotational movement of the body 60 more efficiently (e.g. by affecting back and forth directions). In some examples, the engagement surface 67 formed at the end of the second support element may define one or more indentations (not shown) that are formed offset from the longitudinal axis of the body 60, restricting the rotational movement of the body.

In some examples, the body 60 may be disposed within the recess 22 of the housing 20 such that the first and second shafts 64, 68 may be attached to the first and second walls 25, 26 of the housing 20 via the apertures. In this configuration, the body 60 may be adapted to rotate relatively to the housing 20. The apertures may be located in any appropriate place on the first and second walls 25, 26, such that the body 60 is capable of rotating. It is envisioned that the body 60 may be detachably connected to the housing 20. The body 60 may be formed of any appropriate material, for example, a polymer.

At least one facet 62 of the body 60 may have a lubricating element 70 thereon. However, it is envisioned that any number of the facets 62 may have a lubricating element 70. In some examples, two or more facets 62 may have a lubricating element 70. It is envisioned that the lubricating elements 70 on each of the facets 62 may provide any combination of lubricating aids or skin benefits, e.g., all of the lubricating elements 70 on each of the facets 62 may provide the same benefits, each lubricating elements 70 may provide different benefits, or any combination thereof. The lubricating element 70 may be attached to the body 60 by any suitable means, for example, gluing, ultrasonically welding, co-injecting, or in any combination of the above. The lubricating element 70 may be formed as any suitable shape, for example, a semi-circular, rectangular, square, mushroom shaped, etc.

The lubricating element 70 may comprise a two-layered structure, where the bottom layer, which is attached to the body 60, contains a lubricious composition and the top, outermost, layer contains a thin, hydrophobic film so as to keep the lubricating surfaces protected. This film can protect the first used lubricating element 70 on the first facet 62 of the body 60 until the film wears off due to abrasion. Additionally, this film protects the lubricating elements 70 on the remaining facets 62 from being depleted before being used.

The hydrophobic film works by creating a micro- or nano-sized structure on a surface providing water-repellent properties. Indicative examples of hydrophobic coatings may be manganese oxide polystyrene (MnO2/PS) nano-composite, zinc oxide polystyrene (ZnO/PS) nano-composite, fluorinated silanes and fluoropolymer coatings and silica-based coatings, which are gel-based and can be easily applied either by dipping the object into the gel or via aerosol spray. These hydrophobic structures are thin and very delicate, and thus can be easily damaged by wear due to abrasion/friction. Therefore, after the first few times a razor is used, the hydrophobic layer of the first used lubricating element 70 wears off, revealing the layer with the lubricious composition, while the rest facets remain protected during shaving.

The lubricious composition of the bottom layer of every facet can fundamentally comprise a water-soluble component (e.g., polyethylene oxide generally known as POLYOX or ALKOX) and a water-insoluble component (e.g. high impact polystyrene). Examples of rigid water-insoluble components are polystyrene, styrene co-polymers, polyethylene, polypropylene, polyacetal, acrylonitrile-butadiene-styrene copolymer, ethylene vinyl acetal copolymer, polylactic acid, polycarbonate, maleic anhydride ethylene co-polymer blends, polyether-containing block copolymers (e.g. with polyamide), blends and copolymers of the above with or without other additives. Examples of elastic water-insoluble components are thermoplastic elastomer compounds (TPEs), more specifically thermoplastic poly-urethanes, and/or silicone polymers. Typical examples of water-soluble components are polyethylene oxide and/or polyethylene glycol, polyvinyl pyrrolidone, polyacrylamide, polyhydroxymethacrylate, polyvinyl imidazoline, polyvinyl alcohol, polyhydromethymethacrylate, silicone polymers, blends and copolymers of the above. The lubricious composition may additional contain other ingredients selected in the group of plasticizers, such as low molecular weight polyethylene glycols, water-swellable release enhancing agents, such as cross-linked polyacrylics and/or maleic anhydride compounds, additional lubricants, compatibilizers, and/or skin care agents selected in the group consisting of vitamins, botanical extracts, salts, humectants, silicon oils, organic oils, waxes, antioxidants, exfoliants, anti-bacterial agents, anti-microbial, antiseptics, biocides, preservatives, skin soothing agents, hydrating agents, skin protectants, colorants, film formers, processing thickening agents from the list of silica, fume silica, $TiO_2$ particles, and combinations thereof. The lubricious composition of each facet may be different including several cosmetic ingredients that achieve multiple skin benefits. Alternative lubricious compositions are known and disclosed in patent applications, such as in US20090223057—where as additional ingredients may be included emulsifiers, surfactants, skin conditioners, fragrances, depilatory agents, cleaning agents, medicinal agents; U.S. Pat. No. 8,236,214—where as additional ingredient may be included mineral oil; U.S. Pat. No. 5,713,131, US2016338928—where as additional ingredients may be included cooling agents; US2013042482—where as additional ingredients may be included anti-irritation agents such as a pyrithione or a polyvalent metal salt of pyrithione; CN105219007—where as additional ingredient may be included moisturizing agent selected from olive oil, jojoba oil and glycerin; EP0551407—where as additional ingredients may be included essential oil materials such as menthol, eugenol, eucalyptol, saffrol or methyl salicylate.

Further, it is envisioned that the top layer of the lubricating elements 70 may also bear undulations or patterns (e.g., logos, indicia, etc.), so as to function as slight protrusions, allowing the user to exploit them as artificial gripping points and to twist the facet 62. For example, the combination of the protrusions and tiny gaps that are formed between them provides a textured surface that operates as a gripping area.

Figure 4:
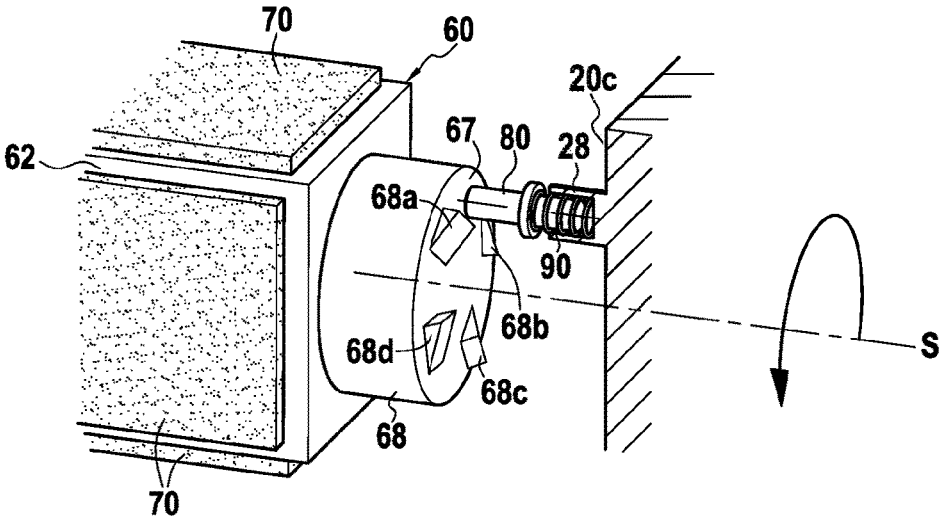
FIG. 4 details a perspective view of the end of the second support element (being a shaft) of the multi-faceted body and the locking mechanism.

As can be seen in FIGS. 2B and 4, the blade assembly further includes a locking mechanism 80. The locking mechanism 80 may be disposed in the second side 20*b* of the housing 20. The locking mechanism 80 can be adapted to selectively restrict the rotational movement of the body 60. The locking mechanism 80 may be formed as a plunger or as a pin or as a shaft. The locking mechanism 80 may have any suitable shape, for example, a cylinder or a rectilinear prism. A spring 90 may be disposed around at least a portion of the outer surface of the locking mechanism 80. The spring 90 may be configured to urge the locking mechanism 80 into a locking position. Thus, it may lock effectively the locking mechanism 80 in place preventing unwanted movement of the body 60 during a shaving operation. The spring 90 may urge the locking mechanism 80 to engage the engagement surface 67 formed at the end of the second support element. The spring 90 may be configured to adopt two states, an extended state in which rotation of the body 60 is restricted and a compressed state in which rotation of the body 60 is permitted.

Focusing on FIG. 4, the housing 20 may include a retaining portion 28 formed on an interior surface 20*c* of the second wall 26 in the second side of the housing 20. The locking mechanism 80 may be disposed within the retaining portion 28. The retaining portion 28 may be adapted to restrict the movement of the locking mechanism 80 and spring 90 to be substantially parallel to the longitudinal axis S-S. The retaining portion 28 may be configured as the female connection portion and the locking mechanism 80 and spring 90 may be formed as the male connection portion. This particular arrangement is depicted in FIG. 4; however, the retaining portion 28 may be configured as the male connection portion and the locking mechanism 80 and spring 90 may be formed as the female connection portion, for example, the spring 90 and locking mechanism 80 are formed around the outer surface of the retaining portion 28. In some examples, the spring 90 may be fixed to and disposed around the outer surface of the locking mechanism 80, permitting the locking mechanism 80 and the spring 90 to operate in concert.

The retaining portion 28 may be offset from the longitudinal axis S-S such that the locking mechanism 80 is aligned with at least one protuberance 68*a*-68*d* formed on the engagement surface of the end of the second support element, which may be formed as a shaft 68. The locking mechanism 80 may be offset from the longitudinal axis S-S of the body 60 and may be configured to contact the engagement surface 67 formed at the end of the second support element. Thus, the locking mechanism 80 being offset from the longitudinal axis S-S of the body allows the locking mechanism 80 to be positioned between adjacent protuberances on the engagement surface 67 of the second support element, when the spring 90 is in an extended state. In particular, the adaptive connection between the locking mechanism 80, spring 90, and protuberances 68*a*-68*d* is configured to restrict the rotational movement of the body 60 such that the body 60 does not rotate while a user is shaving. In other words, the locking mechanism 80 may be adapted to restrict the rotation of the body 60 by the spring 90 urging the locking mechanism 80 to engage the engagement surface 67 formed at the end of the second support element. Regarding the engagement surface 67, it is also envisioned in some examples that the engagement surface of the second end of the support element may be formed with one or more indentations that may be configured to receive the locking mechanism 80. Further, it is also envisioned that the support element may be formed as having any combination of protuberances and indentations.

In operation, for example, assuming that one of the lubricating elements 70 has already been depleted by a user; the user may want to use a lubricating element 70 that is new. With the aforementioned configuration, the user may apply a rotational force on the body 60 about the longitudinal axis S-S (this is shown in FIG. 4 as a counter-clockwise force), thereby rotating the used lubricating element 70 on the first facet out of the use position and simultaneously rotating the unused lubricating element 70 on the second facet into the use position.

During this rotating operation, the locking mechanism 80 contacts one of the protuberances 68*a*. In this example, the protuberance is ramp shaped. As the body 60 is being rotated, the locking mechanism 80 is sliding along the surface of the ramp shaped protuberance 68*a* which causes the locking mechanism 80 to translate away from the body 60 parallel to the longitudinal axis S-S. This movement compresses the spring 90 between the locking mechanism 80 and the retaining portion 28. Particularly, the locking mechanism 80 may be configured to slide relative to the retaining portion 28 of the housing 20.

Once the protuberance 68*a* is rotated past the locking mechanism 80, the spring 90 decompresses and translates the locking mechanism 80 toward the body 60, in a direction that is parallel to the longitudinal axis S-S, until the locking mechanism 80 contacts the engagement surface 67 of the end of the second support element, which may be formed as the second shaft 68. In this configuration, the locking mechanism 80 is lodged between protuberances 68*a* and 68*b* into a locking position, thereby restricting the rotational movement of the body 60. Therefore, the locking mechanism 80 prevents unwanted movement of the body 60 during a shaving operation.

Figure 5:
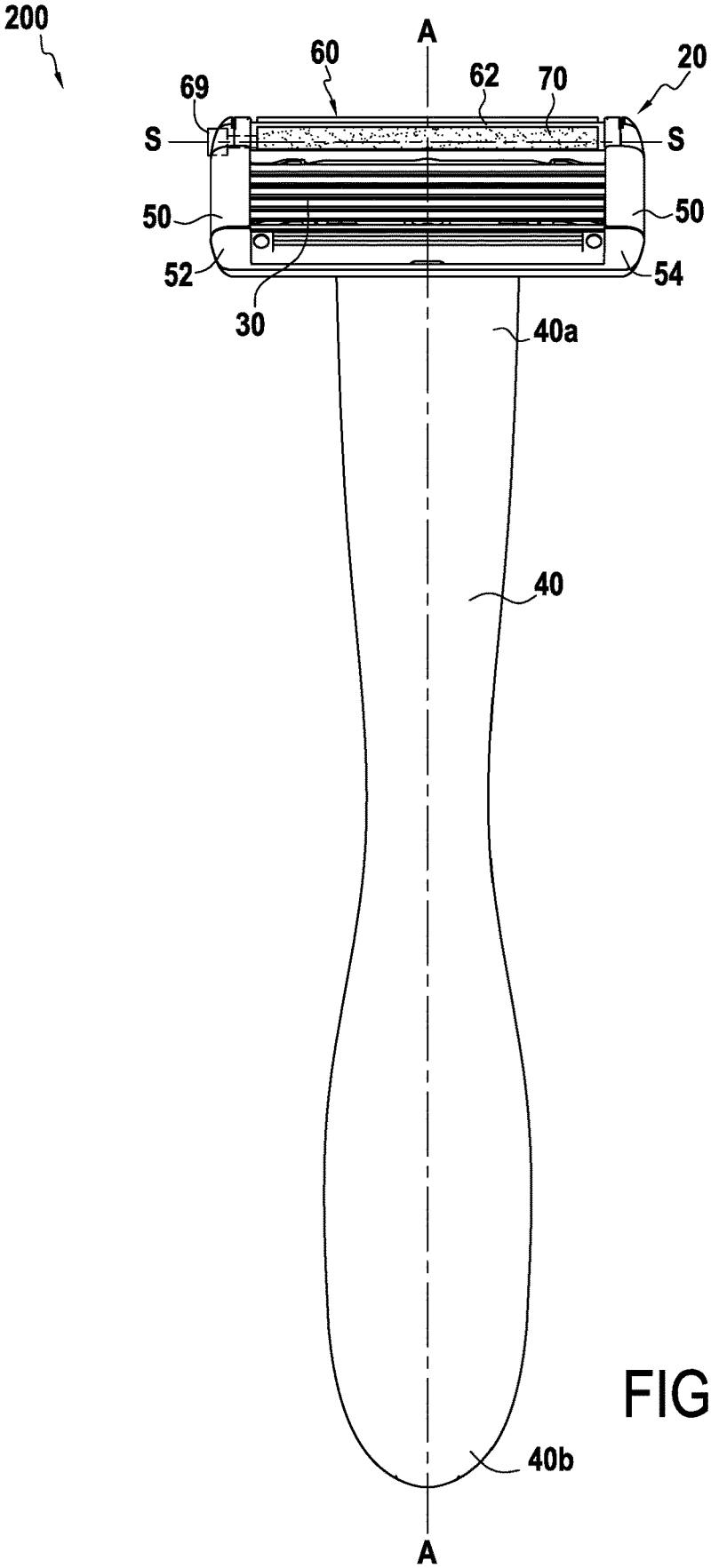
FIG. 5 details a front view of a modified version of the razor of FIG. 1 having a toggle.
Figure 6A:
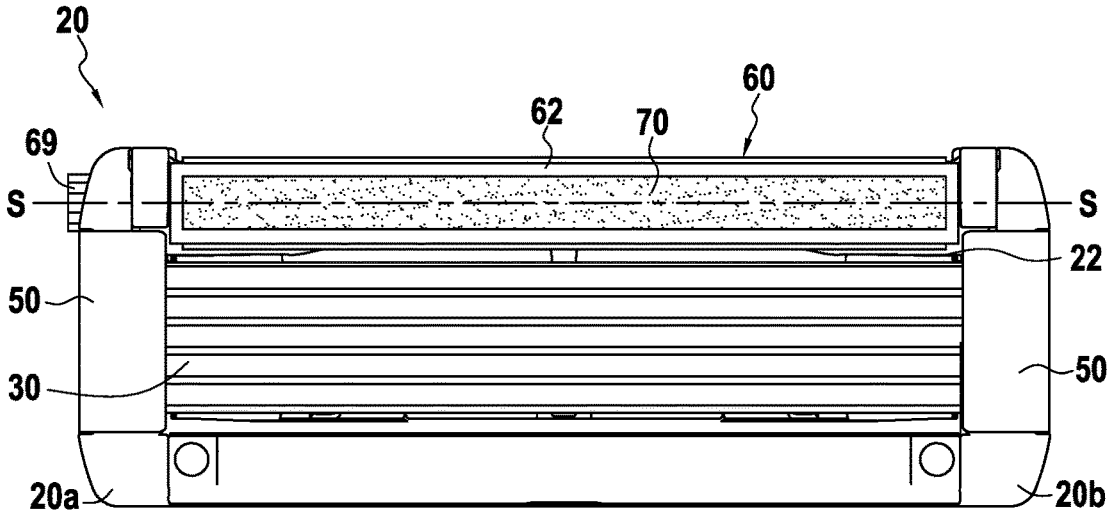
FIG. 6A details a front view of the blade assembly of the razor of FIG. 5.
Figure 6B:
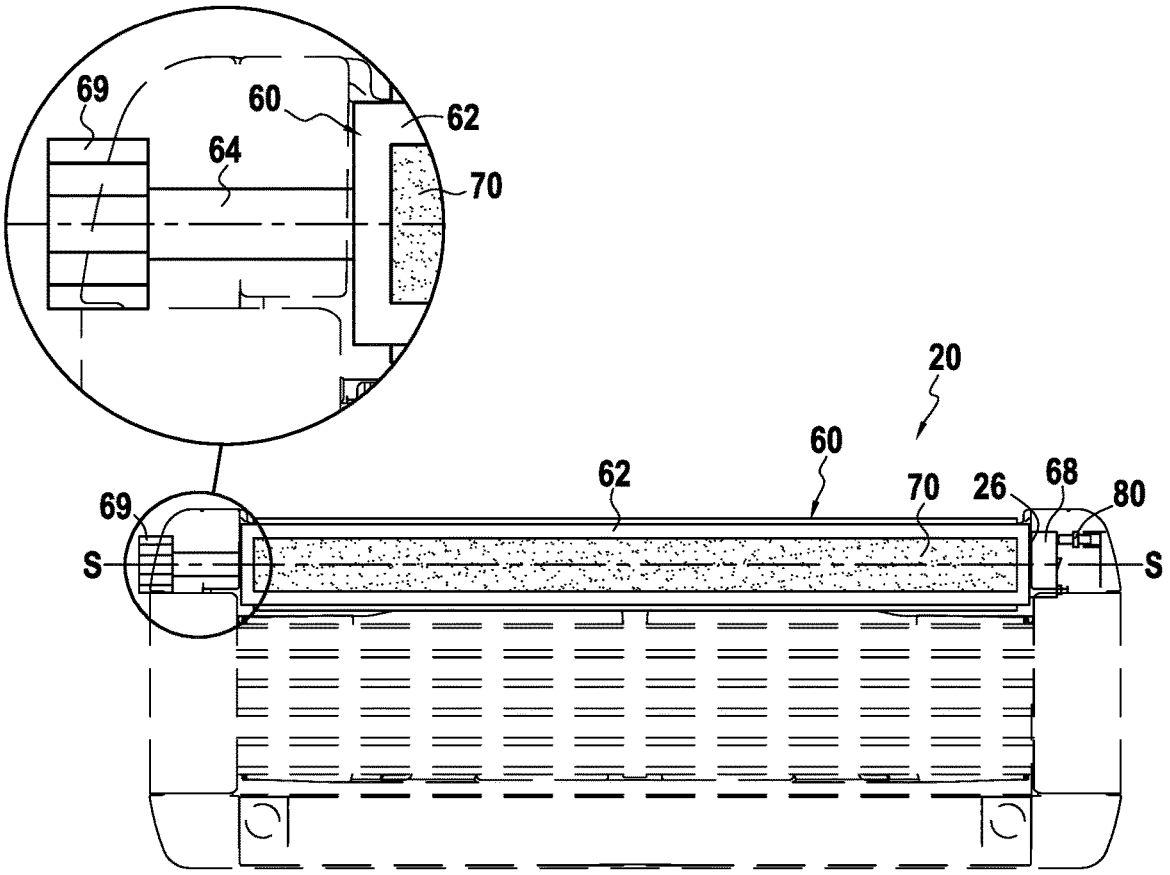
FIG. 6B details a cross-sectional view of the blade assembly of FIG. 6A.

A modified version of the abovementioned razor is shown in FIGS. 5-6B. The razor 200 is the same as the razor 100 except that the first support element is shaft 64 of the body 60 that extends away from the body 60, through the housing 20. The end of the first support element that is a first shaft 64 may be formed as a toggle 69 that allows the user to rotate the body 60 by applying a rotational force on said toggle 69.

Figure 7:
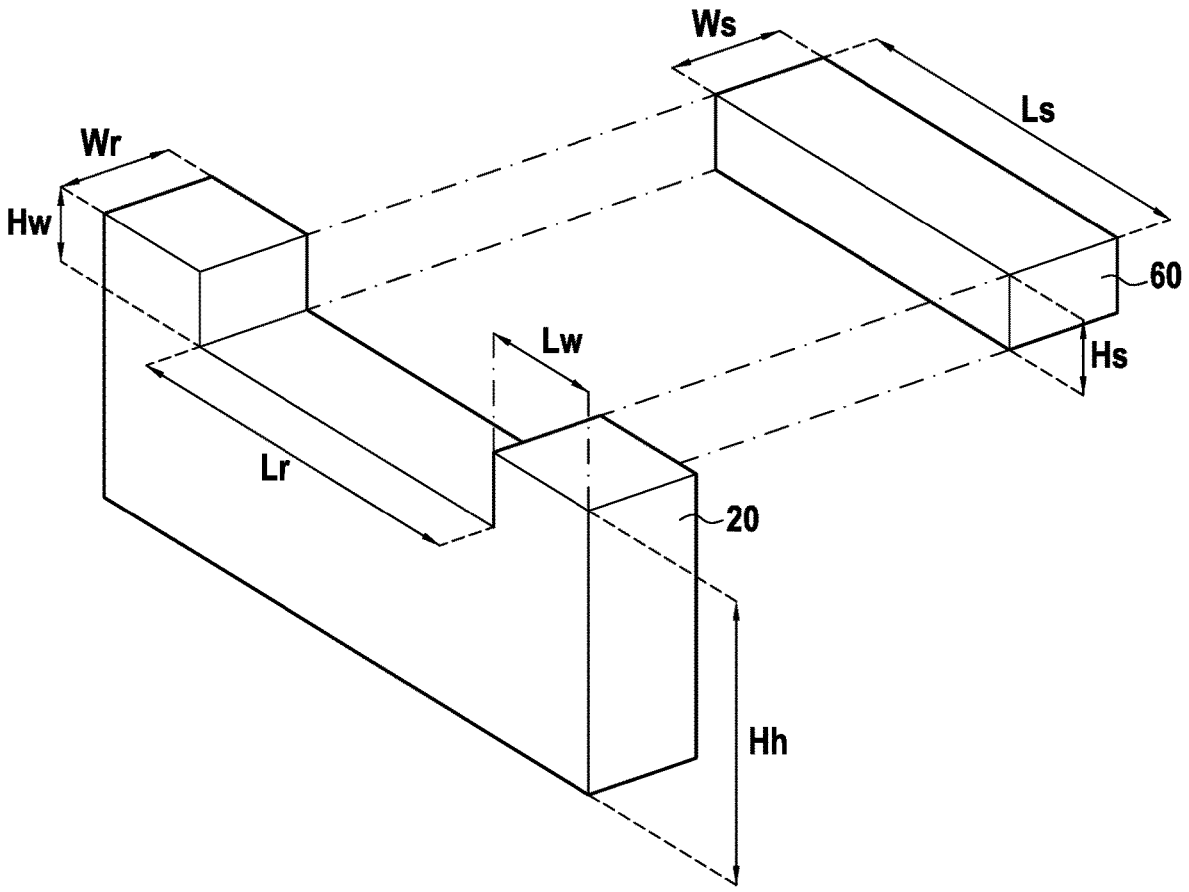
FIG. 7 details a perspective view of a multi-faceted body and housing.

Shown in FIG. 7 is a schematic version of the housing 20 and the body 60 of FIGS. 2A and 6A. The housing 20 may have a total height Hh that may be 10-15 mm. The recess of the housing 20 may have a length Lr in a range of 25-35 mm. The width Wr of the recess may be in a range of 4-5 mm. The length Lw of each of the first and second walls 25, 26 of the housing 20 may be 2-5 mm and the height Hw of the walls 25, 26 may be 5-5.5 mm.

The body 60 may have a length $L_s$ of 24.6-34.6 mm, a height $H_s$ and width $W_s$ that is 3.5 mm.

The aforementioned dimensions are for exemplary purposes only. As detailed in the application, the housing and the body have any suitable shape, for example, the body 60 may be formed as a triangular prism. Thus, the invention may have any suitable dimensions.

While aspects of the disclosure have been described in detail in the foregoing description, the same is to be considered as illustrative and not restrictive in character, it being understood that only some aspects have been shown and described and that all changes and modifications that come within the scope of the claims are to be protected. It is intended that combinations of the above-described elements and those within the specification may be made, except where otherwise contradictory. Although aspects of the disclosure have been described, it would be obvious to those skilled in the art that various other changes and modifications can be made without departing from the scope of the claims. It is therefore intended to cover in the appended claims all such changes and modifications that are within the scope of the disclosure.

The invention claimed is:

1. A blade assembly comprising:

a housing having a first wall on a first side of the housing and a second wall on a second side of the housing, wherein the first wall and the second wall define a recess;

at least one blade within the housing;

an elongated body that is attached to the first and second walls and is rotatable about a longitudinal axis (S-S) of the elongated body, the elongated body having opposing ends and two or more facets between the opposing ends, wherein at least one of the facets has a lubricating element disposed thereon; and a locking mechanism configured to releasably lock the elongated body in a use position, wherein one of the facets faces a same direction as the at least one blade in the use position, wherein the second side of the housing includes a retaining portion formed on an interior surface of the second wall, wherein the locking mechanism is disposed within the retaining portion, and wherein the locking mechanism is configured to slide relative to the retaining portion of the housing.

2. The blade assembly according to claim 1, wherein the locking mechanism is configured to move in a direction parallel to the longitudinal axis (S-S).

3. The blade assembly according to claim 1, wherein two or more facets of the elongated body have a lubricating element disposed thereon.

4. The blade assembly according to claim 1, wherein the locking mechanism includes a locking member and a spring, and wherein the locking member is configured to translate within the retaining portion in a first direction and in a second direction.

5. The blade assembly according to claim 4, wherein the locking member includes a radial protrusion, wherein the spring is positioned between the radial protrusion and an interior surface of the retaining portion, and wherein the spring is configured to compress when the locking member translates in the first direction and the spring is configured to extend when the locking member translates in the second direction.

6. The blade assembly according to claim 4, wherein the locking member is a plunger, a pin, or a shaft.

7. The blade assembly according to claim 1, wherein the elongated body further includes a first support element comprising either a first shaft or a first recess, and a second support element comprising either a second shaft or a second recess, each of the first and second support elements being formed along the longitudinal axis (S-S) of the elongated body, wherein the first support element corresponds with the first wall and the second support element corresponds with the second wall so that the elongated body is rotatably attached to the housing.

8. The blade assembly according to claim 7, wherein the first support element is the first shaft which extends through the first side of the housing.

9. The blade assembly according to claim 7, wherein the elongated body further includes a toggle fixed to an end of the first shaft.

10. The blade assembly according to claim 9, wherein the toggle is adapted to drive rotation of the elongated body.

11. The blade assembly according to claim 7, wherein the locking assembly slides is configured to slide against the second support element.

12. The blade assembly according to claim 7, wherein an end of the second support element comprises one or more protuberances that are formed offset from the longitudinal axis (S-S) of the elongated body.

13. The blade assembly according to claim 12, wherein the second support element comprises the second shaft including an engagement surface, wherein the engagement surface comprises a plurality of protuberances that are formed offset from the longitudinal axis (S-S) of the elongated body.

14. The blade assembly according to claim 13, wherein the locking assembly is configured to slide between and against each of the plurality of protuberances.

15. The blade assembly according to claim 12, wherein the locking mechanism includes a locking member and a spring, and wherein the locking mechanism is adapted to restrict the rotation of the elongated body by the spring urging the locking member to engage an engagement surface formed at the end of the second support element.

16. The blade assembly according to claim 15, wherein the locking mechanism is offset from the longitudinal axis (S-S) of the elongated body and the locking member is configured to contact the engagement surface formed at the end of the second support element.

17. The blade assembly according to claim 15, wherein the spring is configured to adopt two states, an extended state in which the locking member contacts the engagement surface and a compressed state in which the locking member is translated away from the engagement surface.

18. A razor comprising:

the blade assembly according to claim 1; and a handle connected to the blade assembly.

19. A blade assembly comprising:

a housing having a first wall on a first side of the housing and a second wall on a second side of the housing, wherein the first wall and the second wall define a recess;

at least one blade within the housing;

an elongated body disposed within the recess and attached to the first wall and the second wall, wherein the elongated body is rotatable about a longitudinal axis (S-S) of the elongated body and the elongated body is rotatable relative to the at least one blade, wherein the elongated body includes a first end and a second end, and a plurality of facets between the first end and the second end, wherein at least one of the plurality of facets has a lubricating element disposed thereon; and a locking mechanism disposed in the housing between the elongated body and a surface of the housing, the locking mechanism being configured to releasably lock the elongated body in a use position in which one of the facets faces a same direction as the at least one blade.

20. A blade assembly comprising:

a housing having a first wall on a first side of the housing and a second wall on a second side of the housing, wherein the first wall and the second wall define a recess;

at least one blade within the housing;

an elongated body disposed within the recess and attached to the first wall and the second wall, wherein the elongated body is rotatable about a longitudinal axis (S-S) of the elongated body, wherein the elongated body includes a first end, a second end, and a plurality of facets between the first end and the second end, and at least one of the plurality of facets has a lubricating element disposed thereon; and a locking mechanism disposed in the housing between the elongated body and a surface of the housing, the locking mechanism being configured to releasably lock the elongated body in a use position in which one of the facets faces a same direction as the at least one blade, wherein the second end comprises a plurality of protuberances that are formed offset from the longitudinal axis (S-S) of the elongated body, and the locking mechanism is configured to slide between and against each of the plurality of protuberances.

* * * * *